US006541691B2

(12) United States Patent
Tolonen et al.

(10) Patent No.: US 6,541,691 B2
(45) Date of Patent: Apr. 1, 2003

(54) GENERATION OF A NOTE-BASED CODE

(75) Inventors: Tero Tolonen, Helsinki (FI); Ville Pulkki, Espoo (FI)

(73) Assignee: Oy Elmorex Ltd., Espoo (FI)

( * ) Notice: Subject to any disclaimer, the term of this patent is extended or adjusted under 35 U.S.C. 154(b) by 0 days.

(21) Appl. No.: 09/893,661

(22) Filed: Jun. 29, 2001

(65) Prior Publication Data

US 2002/0035915 A1 Mar. 28, 2002

(30) Foreign Application Priority Data

Jul. 3, 2000 (FI) ..... 20001592

(51) Int. Cl.[7] ..... G10H 7/00

(52) U.S. Cl. ..... 84/616; 84/603; 84/609; 84/649; 84/654

(58) Field of Search ..... 184/600–603, 184/609–610, 616, 634, 649–650, 654, 666

(56) References Cited

U.S. PATENT DOCUMENTS

| | | | | |
|---|---|---|---|---|
| 4,392,409 | A | 7/1983 | Coad, Jr. et al. | |
| 4,546,690 | A | 10/1985 | Tanaka et al. | |
| 5,250,745 | A | 10/1993 | Tsumura | |
| 5,418,323 | A | 5/1995 | Kohonen | |
| 6,372,973 | B1 * | 4/2002 | Schneider | 84/609 |

FOREIGN PATENT DOCUMENTS

| | | |
|---|---|---|
| WO | WO 82/00379 | 2/1982 |

OTHER PUBLICATIONS

Wolfgang J. Hess: "Pitch and Voicing Determination" University of Bonn, Bonn, Germany pp. 3–48.

Charles W. Therrien: "Discrete Random Signals and Statistical Signal Processing" Naval Postgraduate School, Monterey, CA, Prentice Hall Signal Processing Series, Prentice Hall, Englewood Cliffs, NJ 07632, pp. 422–431.

Lawrence R. Rabiner: "On the Use of Autocorrelation Analysis for Pitch Detection" IEEE Transactions on Acoustics, Speech, and Signal Processing, vol. ASSP 25, No. 1, Feb. 1977, pp. 24–33.

* cited by examiner

*Primary Examiner*—Marlon T. Fletcher
(74) *Attorney, Agent, or Firm*—Nixon & Vanderhye P.C.

(57) ABSTRACT

A method for generating accompaniment to a musical presentation, the method comprising steps of providing a note-based code representing musical information corresponding to the musical presentation, generating a code sequence corresponding to new melody lines by using said note-based code as an input for a composing method, and providing accompaniment on the basis of the code sequence corresponding to new melody lines. Providing the note-based code representing the musical information comprises steps of receiving the musical information in the form of an audio signal, and applying an audio-to-notes conversion to the audio signal for generating the note-based code representing the musical information, the audio-to-notes conversion comprising the steps of estimating fundamental frequencies of the audio signal for obtaining a sequence of fundamental frequencies, and detecting note events on the basis of the sequence of fundamental frequencies for obtaining the note-based code.

8 Claims, 7 Drawing Sheets

GENERATION OF A NOTE-BASED CODE

FIELD OF THE INVENTION

The invention relates to a method for generating a note-based code representing musical information. Further, the invention relates to a method for generating accompaniment to a musical presentation.

BACKGROUND OF THE INVENTION

Generally, there are various prior art methods for producing control signals used for the control of electronic musical instruments or synthesizers. For example, MIDI is widely used for controlling electronic musical instruments. The abbreviation MIDI stands for Musical Instrument Digital Interface and this is a de facto industry standard in sound synthesizers. MIDI is an interface through which synthesizers, rhythm machines, computers, etc., can be linked together. Information on MIDI standards can be found e.g. from [1].

A non-heuristic automatic composition method is disclosed in [2]. This composition method utilizes a principle of self-learning grammar system called dynamically expanding context (DEC) in the production of a continuous sequence of codes by learning its rules from a given set of examples, i.e. similarly as in Markov processes, a code in a sequence of codes is defined in the composing method on the basis of codes immediately preceding it. The composition method, however, uses discrete "grammatical" rules in which the length of the contents of the search arguments of the rules, i.e. the number of required preceding codes, is a dynamic parameter which is defined on the basis of discrepancies (conflicts) occurring in the training sequence (strings) when the rules are being formed from the training sequences. In other words, if two or more rules have the same search argument but different consequences, i.e. a new code, during the production of the rules, these rules are indicated to be invalid, and the length of their search argument is increased until unambiguous or valid rules are found. The method of dynamically expanding the context is to a very great extent based on the utilization of this structure. As the mentioned rules are produced mechanically on the basis of local equivalences between symbols occurring in the training material, the production of rules does not, for instance, require music-theoretical analysis based on expertise on the training music material.

Correspondingly, when the rules are utilized to generate a new code after a sequence of codes, the code generated last in the code sequence is first compared with the rules in a search table stored in the memory, then the two last codes are compared, etc., until equivalence is found with the search argument of a valid rule, whereby the code indicated by the consequence of this rule can be added last in the sequence of codes. The above-mentioned tree structure enables systematic comparisons. This results in an "optimal" sequence of codes which "stylistically" attempts to follow the rules produced on the basis of the training sequences.

According to the prior art, the key sequence (a note-based code) for an automatic accompanist can be produced for example by a MIDI keyboard that is connected to a MIDI port in a computer, or it can be loaded from a MIDI file stored in a memory. The MIDI keyboard produces note events comprising note-on/note-off event pairs and the pitch of the note as the user plays the keyboard. For the accompanist the note events are converted into a sequence of single length units, e.g. quavers (⅛ notes), of the same pitch. The key sequence can also be given by other means; for example by using a graphical user interface (GUI) and an electronic pointing device, such as a mouse, or by using a computer keyboard.

DISCLOSURE OF THE INVENTION

An object of the present invention is to provide a method for generating a note-based code representing musical information and further a method for generating accompaniment to a musical presentation. This and other objects are achieved with methods and computer software which are characterized by what is disclosed in the attached independent claims. Preferred embodiments of the invention are disclosed in the attached dependent claims.

The method according to the invention is based on receiving musical information in the form of an audio signal and applying an audio-to-notes conversion to the audio signal for generating the note-based code representing the musical information.

The audio signal is produced for example by singing, humming, whistling or playing an instrument. Alternatively, the audio signal may be output from a computer storage medium, such as a CD or a floppy disk.

In a further method according to the invention, the note-based code generated on the basis of an audio signal by the audio-to-notes conversion is used for controlling an automatic composition method in order to provide accompaniment to a musical presentation. The automatic composition method has been described in the background part of this application. The automatic composition method generates a code sequence corresponding to new melody lines on the basis of the note-based code. This code sequence may be used for controlling a synthesizer or a similar electronic musical device for providing audible accompaniment. Preferably, the accompaniment is provided in real time. The code sequence corresponding to new melody lines may also be stored in a MIDI file or in a sound file. Herein, the term 'melody line' refers generally to a musical content formed by a combination of notes and pauses. In contrast to the new melody lines, the note-based code may be considered as an old melody line.

The audio-to-notes conversion method according to the invention comprises estimating fundamental frequencies of the audio signal for obtaining a sequence of fundamental frequencies and detecting note events on the basis of the sequence of fundamental frequencies for obtaining the note-based code.

In an audio-to-notes conversion method according to an embodiment of the invention, the audio signal containing musical information is segmented into frames in time, and the fundamental frequency of each frame is detected for obtaining a sequence of fundamental frequencies. In the next phase, the fundamental frequencies are quantized, i.e. converted for example into a MIDI pitch scale, which effectively quantizes the fundamental frequency values into a semitone scale. The segments of consecutive equal MIDI pitch values are then detected and each of these segments is assigned as a note event (note-on/note-off event pair) for obtaining the note-based code representing the musical information.

In an audio-to-notes conversion method according to another embodiment of the invention, the audio signal containing musical information is processed in frames. The fundamental frequency of each frame is detected and the fundamental frequencies are quantized. As distinct from the previous embodiment, the frames are processed one by one at the same time as the audio signal is being provided. The quantized fundamental frequencies are coded into note events in real time by comparing the present fundamental frequency to the previous fundamental frequency. Any transition from zero to a non-zero value is assigned to a note-on event and a pitch corresponding to the current fundamental frequency. Accordingly, a transition from a non-zero to a zero value results in a note-off event and a change from a non-zero to another non-zero value results in a note-off event and a note-on event after the note-off event and a pitch corresponding to the current fundamental frequency. Hence, the note-based code representing musical information is constructed at the same time as the input signal is provided.

In an audio-to-notes conversion method according to still another embodiment of the invention, the audio signal containing musical information is processed in frames, and the note-based code representing musical information is constructed at the same time as the input signal is provided. The signal level of a frame is first measured and compared to a predetermined signal level threshold. If the signal level threshold is exceeded, a voicing decision is executed for judging whether the frame is voiced or unvoiced. If the frame is judged voiced, the fundamental frequency of the frame is estimated and quantized for obtaining a quantized present fundamental frequency. Then, it is decided on the basis of the quantized present fundamental frequency whether a note is found. If a note is found, the quantized present fundamental frequency is compared to the fundamental frequency of the previous frame. If the previous and present fundamental frequencies are different, a note-off event and a note-on event after the note-off event are applied. If the previous and present fundamental frequencies are the same, no action will be taken. If the signal level threshold is not exceeded or if the frame is judged unvoiced or if no note is found, it is detected whether a note-on event is currently valid and if a note is found, a note-off event is applied. The procedure is repeated frame by frame at the same time as the audio signal is received for obtaining the note-based code.

An advantage of the method according to the invention is that it can be used by people without any knowledge of musical theory for producing a note-based code representing musical information by providing the musical information in the form of an audio signal for example by singing, humming, whistling or playing an instrument. A further advantage is that the invention provides means for generating real time accompaniment to a musical presentation.

BRIEF DESCRIPTION OF THE DRAWINGS

In the following, the invention will be described in greater detail by means of the preferred embodiments and with reference to the accompanying drawings, in which.

PREFERRED EMBODIMENTS OF THE INVENTION

The principle of the invention is to generate a note-based code on the basis of musical information given in the form of an audio signal. According to the invention, an audio-to-notes conversion is applied to the audio signal for generating the note-based code. The audio signal may be produced for example by singing, humming, whistling or playing an instrument or it may be output from some type of a computer storage medium, such as a floppy disk or a CD.

The method for generating accompaniment according to the invention employs the automatic composition method disclosed in [2]. According to the invention, the composition method is used for producing accompaniment (new melody lines) to a musical presentation on the basis of a note-based code representing the musical presentation. In the composition method, the code generated last in the sequence of codes is the code that is compared to the rules stored in a search table. When the composition method is used as an automatic accompanist, the note-based input is compared to the rules, but the rules stored in the memory originate from the corresponding accompaniment, i.e. from the code sequence generated by the composition method. According to the method, an audio-to-notes conversion is applied to an audio signal representing the musical presentation for generating a note-based code, and this note-based code is used for controlling the composition method. The automatic composition method generates a code sequence corresponding to new melody lines, i.e. accompaniment.

Figure 1A:
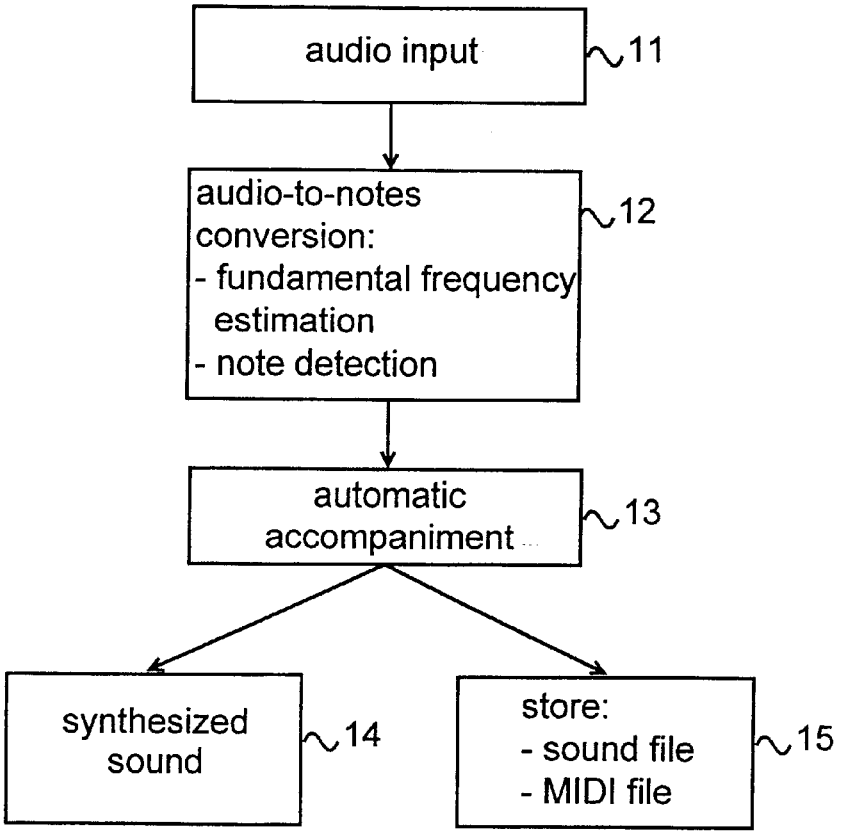
FIG. 1A is a flow diagram illustrating a method according to the invention.

FIG. 1A is a flow diagram illustrating the method for generating accompaniment. In step 11, the audio input representing the musical presentation is received. In step 12, the audio-to-notes conversion is applied to the audio input for generating a note-based code. In a preferred embodiment of the invention, which is described in detail with reference to FIG. 2, the audio-to-notes conversion comprises fundamental frequency estimation and note detection. The note-based code obtained by the audio-to-notes conversion is used for producing automatic accompaniment in step 13. Step 13 is implemented by a composition method which produces code sequences corresponding to new melody lines on the basis of an input, preferably by the above described composition method. In step 14, the code sequence produced by the composition method is used for controlling an electronic musical instrument or synthesizer for producing synthesized sound. Alternatively, in step 15 the accompaniment is stored in a file. The file may be a MIDI file in which sound event descriptions are stored, or it may be a sound file which stores synthesized sound. The sound files may be compressed for saving storage space. Steps 14 and 15 are not mutually exclusive, but both of them may be executed.

Figure 1B:
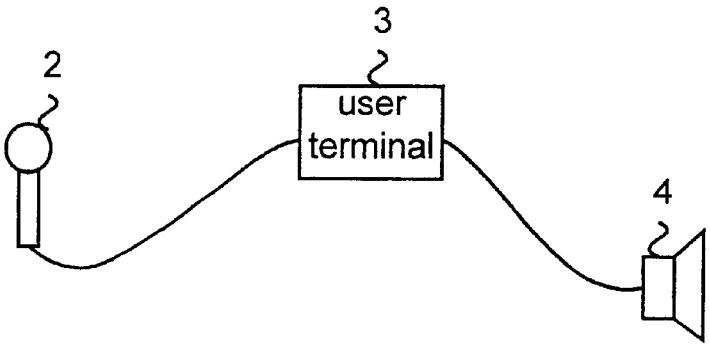
FIG. 1B is a block diagram illustrating an arrangement according to the invention.

FIG. 1B is a block diagram illustrating an arrangement according to the invention for generating automatic accompaniment. The arrangement comprises a microphone 2 which is connected to a user terminal or a host computer 3 and a loudspeaker 4 connected to the user terminal. The microphone 2 is used for inputting the musical presentation in the form of an audio signal. The musical presentation is produced for example by singing, humming, whistling or playing an instrument. The microphone 2 may be for example a separate microphone connected to the host 3 with a cable or a microphone which is integrated into the host 3. The host computer 3 contains software that produces a code sequence corresponding to the accompaniment on the basis of the audio signal, i.e. executes an audio-to-notes conversion and the steps of a composition method. The code sequence may be saved in a file by the host and it may be used for controlling an electronic musical instrument or synthesizer for producing synthesized sound which is output via the loudspeaker 4. The synthesizer may be software run on the host computer or the synthesizer may be a separate hardware device on the host. Alternatively, the synthesizer may be an external device that is connected to the host with a MIDI cable. In the last case, the host provides a MIDI output signal on the basis of the code sequence at a MIDI port. Preferably, the accompaniment is provided in real time. For example, when a user sings into the microphone 2, the computer 3 processes the musical content produced by singing and outputs accompaniment via the loudspeaker 4. This arrangement can be used for improving musical abilities, for example the ability to sing or to play an instrument, of the person producing the musical presentation.

Figure 2:
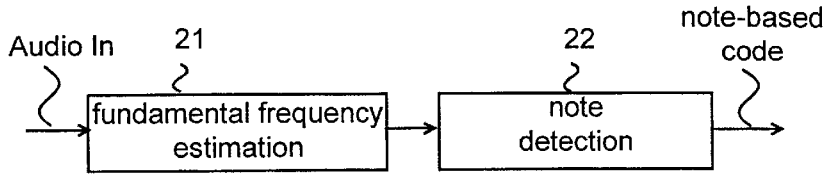
FIG. 2 illustrates an audio-to-notes conversion according to the invention.

An audio-to-notes conversion according to the invention can be divided into two steps shown in FIG. 2: fundamental frequency estimation 21 and note detection 22. In step 21, an audio input is segmented into frames in time and the fundamental frequency of each frame is estimated. The treatment of the signal is executed in a digital domain; therefore, the audio input is digitized with an A/D converter prior to the fundamental frequency estimation if the audio input is not already in a digital form. However, the estimation of the fundamental frequencies is not in itself sufficient for producing the note-based code. Therefore in step 22, the consecutive fundamental frequencies are further processed for detecting the notes. In the following description, the operation of these two steps according to the preferred embodiments of the invention will be explained in detail.

Numerous techniques exist for estimating fundamental frequency of audio signals, such as speech or musical melodies. The use of the autocorrelation function has been widely adopted for the estimation of fundamental frequencies. The autocorrelation function is preferably employed in the method according to the invention for the estimation of fundamental frequencies. However, it is not mandatory for the method according to the invention to employ autocorrelation for the fundamental frequency estimation, but also other fundamental frequency estimation methods can be applied. Other techniques for the estimation of fundamental frequencies can be found for example in [3].

The present estimation algorithm is based on detecting a fundamental period in an audio signal segment (frame). The fundamental period is denoted as $T_o$ (in samples) and it is related to the fundamental frequency as $$f_0 = \frac{f_s}{T_0} \tag{1}$$

where $f_s$ is the sampling frequency in Hz. The fundamental frequency is obtained from the estimated fundamental period by using Equation 1.

Figure 3:
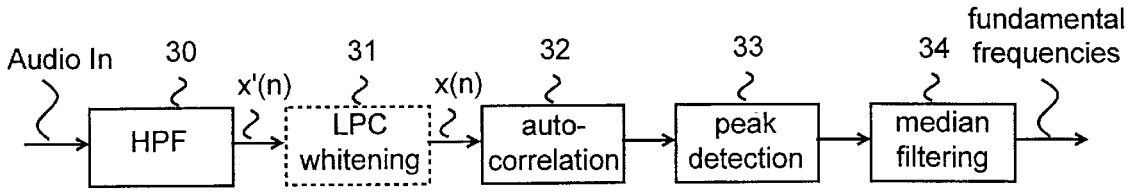
FIG. 3 is a flow diagram illustrating the fundamental frequency estimation according to an embodiment of the invention.

FIG. 3 is a flow diagram illustrating the operation of the fundamental frequency (or period) estimation. The input signal is segmented into frames in time and the frames are treated separately. First, in step 30, the input signal Audio In is filtered with a high-pass filter (HPF) in order to remove the DC component of the signal Audio In. The transfer function of the HPF may be for example $$H(z) = \frac{1 - z^{-1}}{1 - az^{-1}},\ 0 < a < 1 \tag{2}$$

where a is the filter coefficient.

The next step 31 in the chain is optional linear predictive coding (LPC) whitening of the spectrum of the signal segment (frame). In step 32, the signal is then autocorrelated. The fundamental period estimate is obtained from the autocorrelation function of the signal by using peak detection in step 33. Finally in step 34, the fundamental period estimate is filtered with a median filter in order to remove spurious peaks. In the next paragraphs, LPC whitening, autocorrelation and peak detection will be explained in detail.

The human voice production mechanism is typically considered as a source-filter system, i.e. an excitation signal is created and filtered by a linear system that models a vocal tract. In voiced (harmonic) tones or in voiced speech, the excitation signal is periodic and it is produced at the glottis. The period of the excitation signal determines the fundamental frequency of the tone. The vocal tract may be considered as a linear resonator that affects the periodic excitation signal, for example, the shape of the vocal tract determines the vowel that is perceived.

In practice, it is often attractive to minimize the contribution of the vocal tract in the signal prior to the fundamental period detection. In signal processing terms this means inverse-filtering (whitening) in order to remove the contribution of the linear model that corresponds to the vocal tract. The vocal tract can be modeled for example by using an all pole model, i.e. as an Nth order digital filter with a transfer function of $$H(z) = \frac{1}{1 + \sum_{k=1}^{N} a_k z^{-k}} \tag{3}$$

where $a_k$ are the filter coefficients. The filter coefficients may be obtained by using linear prediction, that is by solving a linear system involving an autocorrelation matrix and the parameters $a_k$. The linear system is most conveniently solved using the Levinson-Durbin recursion which is disclosed for example in [4]. After solving the parameters $a_k$, the whitened signal x(n) is obtained by inverse filtering the non-whitened signal x'(n) by using the inverse of the transfer function in Equation 3.

Figure 4A:
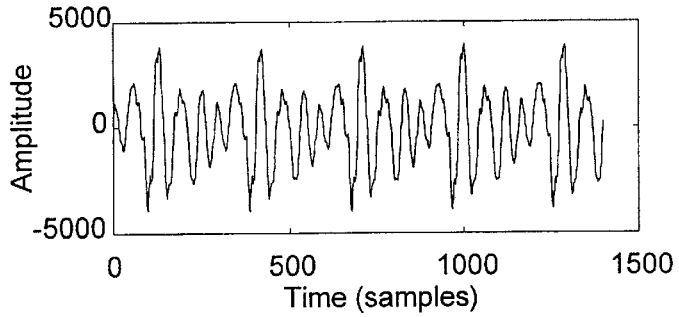
FIGS. 4A and 4B illustrate time-domain windowing.
Figure 4B:
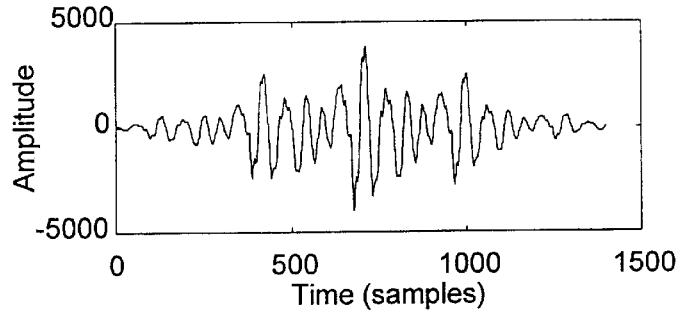

FIGS. 4A and 4B illustrate time-domain windowing. FIG. 4A shows a signal windowed with a rectangular window and FIG. 4B shows a signal windowed with a Hamming window. Windowing is not shown in FIG. 3, but it is assumed that the signal is windowed before the step 32.

Figure 5A:
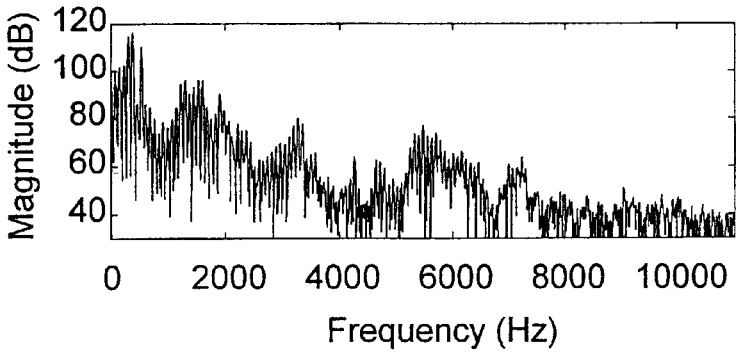
FIGS. 5A to 6B illustrate an example of the effect of the LPC whitening.
Figure 5B:
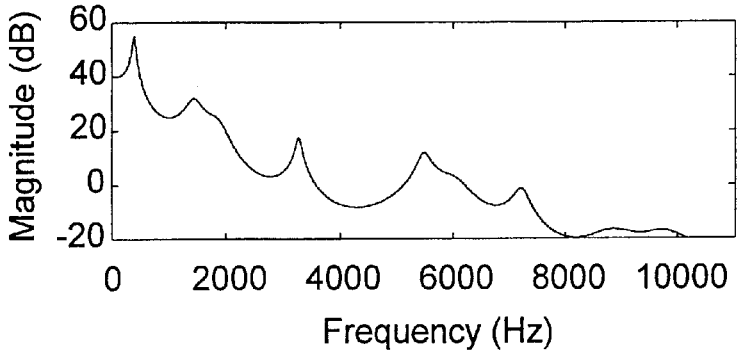
Figure 5C:
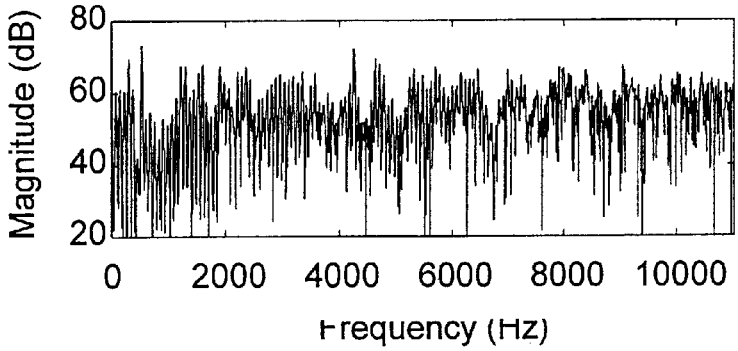
Figure 6A:
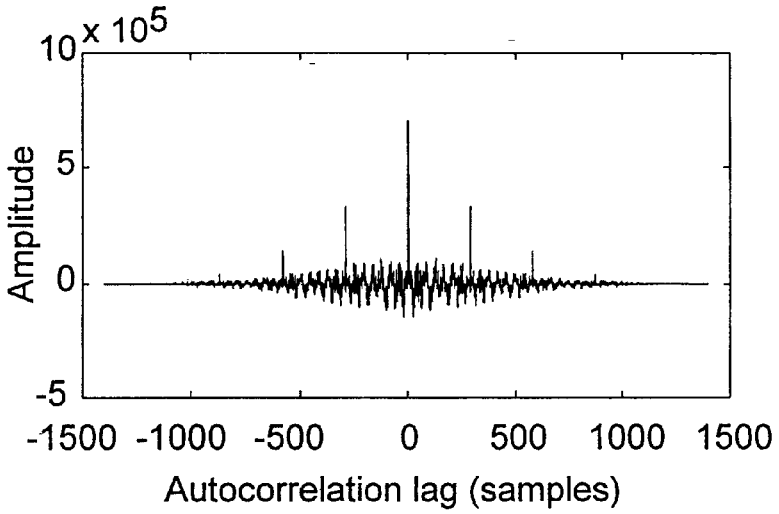
Figure 6B:
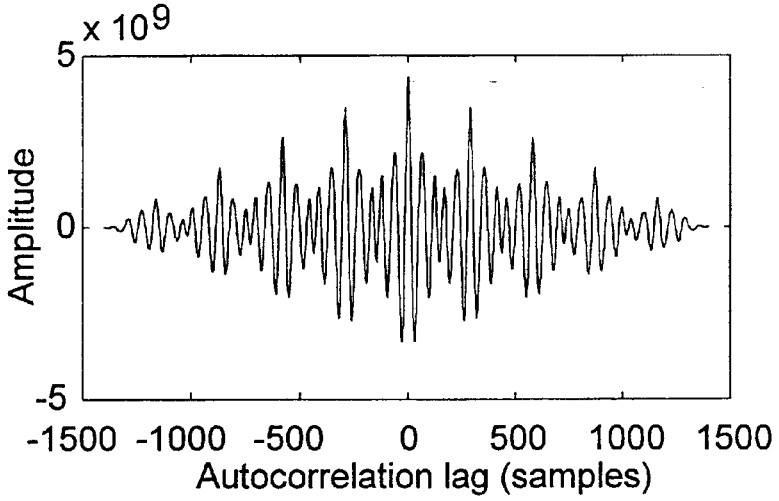

An example of the effect of the LPC whitening is illustrated in FIGS. 5A to 6B. FIGS. 5A, 5B and 5C depict the spectrum, the LPC spectrum and the inverse-filtered (whitened) spectrum of the Hamming windowed signal of FIG. 4B, respectively. FIGS. 6A and 6B illustrate an example of the effect of the LPC whitening in the autocorrelation function. FIG. 6A illustrates the autocorrelation function of the whitened signal of FIG. 5C and FIG. 6B illustrates the autocorrelation function of the (non-whitened) signal of FIG. 5A. It can be seen that local maxima in the autocorrelation function of the whitened spectrum of FIG. 6A stand out relatively more clearly than of the non-whitened spectrum of FIG. 6B. Therefore, this example suggests that it is advantageous to apply the LPC whitening to the autocorrelation maximum detection problem.

However, tests have revealed that in some cases, the accuracy of the estimator decreases with the LPC whitening. This concerns particularly signals that contain high-pitched tones. Therefore, it is not always advantageous to employ the LPC whitening, and the present fundamental period estimation can be applied either with or without the LPC whitening.

The autocorrelation of the signal is implemented by using a short-time autocorrelation analysis disclosed in [5]. The short-time autocorrelation function operating on a short segment of the signal x(n) is defined as $$\phi_k(m) = \frac{1}{N}\sum_{n=0}^{N-1}[x(n+k)w(n)][x(n+k+m)w(n+m)], \quad 0 < m < M_c - 1 \tag{4}$$

where $M_c$ is the number of autocorrelation points to be analyzed, N is the number of samples, and w(n) is the time-domain window function, such as a Hamming window.

The length of the time-domain window function w(n) determines the time resolution of the analysis. In practice, it is feasible to use a tapered window that is at least two times the period of the lowest fundamental frequency. This means that if for example 50 Hz is chosen as the lower limit for the fundamental frequency estimation, the minimum window length is 40 ms. At a sampling frequency of 22 050 Hz, this corresponds to 882 samples. In practice, it is attractive to choose the window length to be the smallest power of two that is larger than 40 ms. This is because the Fast Fourier Transform (FFT) is used to calculate the autocorrelation function and the FFT requires that the window length is a power of two.

Since the autocorrelation function for a signal of N samples is 2N−1 samples long, the sequence has to be zero-padded before FFT calculation. Zero padding simply refers to appending zeros to the signal segment in order to increase the signal length to the required value. After zero-padding, the short-time autocorrelation function is calculated as $$\phi = IFFT(|FFT(x(n))|^2) \tag{5}$$

where x(n) is the windowed signal segment and IFFT denotes the inverse-FFT.

The estimated fundamental period $T_o$ is obtained by peak detection which searches for the local maximum value of $\phi(m)$ (autocorrelation peak) for each k in a meaningful range of the autocorrelation lag m. The global maximum of the autocorrelation function occurs at location m=0 and the local maximum corresponding to the fundamental period is one of the local maxima.

The peak detection is further improved by parabolic interpolation. In parabolic interpolation, a parabola is fitted into the three points consisting of a local maximum and two values adjacent to the local maximum. If $A=\phi(l)$ is the value of the local maximum at autocorrelation lag l, and $A_{-1}=\phi(l-1)$ and $A_{+1}=\phi(l+1)$ are the adjacent values on the left and the right of the maximum at lags l−1 and l+1, respectively, the interpolated location of the autocorrelation peak $\tilde{l}$ is expressed as $$\tilde{l} = l + \frac{1}{2}\frac{A_{-1} - A_{+1}}{A_{-1} - 2A + A_{+1}} \tag{6}$$

The median filter preferably used in the method according to the invention is a three-tap median filter.

Further information on the LPC, autocorrelation analysis, and the FFT can be found in text books on digital signal processing and spectral analysis.

The above described method for estimating the fundamental frequency is quite reliable in detecting the fundamental frequency of a sound signal with a single prominent harmonic source (for example voiced speech, singing, musical instruments that provide harmonic sound). Furthermore, the method derives a time trajectory of the estimated fundamental frequencies such that it follows the changes in the fundamental frequency of the sound signal. However, as was stated before, the time trajectory of the fundamental frequencies needs to be further processed for obtaining a note based code. Specifically, the time trajectory needs to be analyzed into a sequence of event pairs indicating the start, pitch and end of a note, which is referred to as note detection. In other words, the note detection refers to forming note events from the fundamental frequency trajectory. A note event comprises for example a starting position (note-on event), pitch, and ending position (note-off event) of a note. For example, the time trajectory may be transformed into a sequence of single length units, such as quavers according to a user-determined tempo.

Figure 7A:
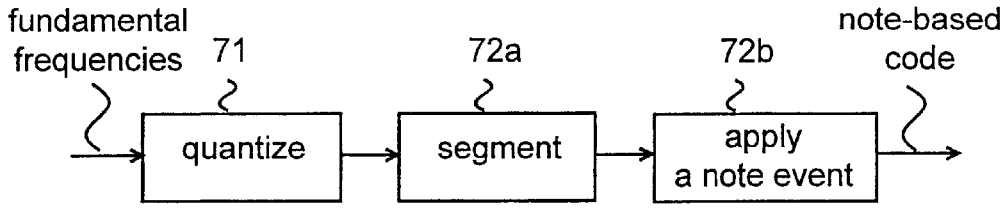
FIG. 7A is a flow diagram illustrating the note detection according to an embodiment of the invention.

FIG. 7A is a flow diagram illustrating the note detection according to an embodiment of the invention in which a sequence of an arbitrary length of fundamental frequencies is processed at a time. In step 71, the fundamental frequencies are quantized. They are for example quantized into nearest semitone and/or converted into MIDI pitch scale or the like. In step 72*a*, the segments of consecutive equal values in the fundamental frequencies are detected and in step 72*b* each of these segments is assigned as a note event comprising a note-on note-off event pair and the pitch corresponding to the fundamental frequency.

Figure 7B:
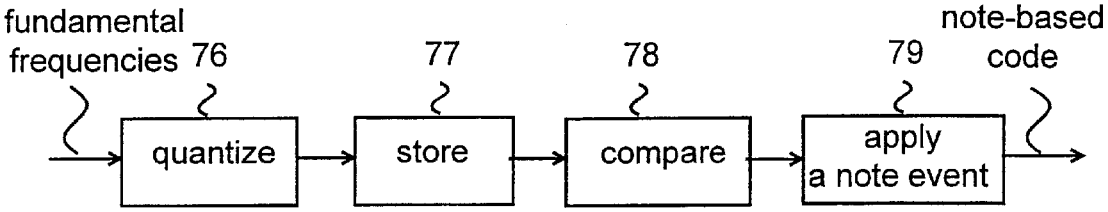
FIG. 7B is a flow diagram illustrating the note detection according to another embodiment of the invention.

FIG. 7B is a flow diagram illustrating the note detection according to another embodiment of the invention in which the fundamental frequencies are processed in real time. The fundamental frequencies are quantized in step 76. However, the frames are processed one by one and no actual segmentation is performed. In step 77, the present fundamental frequency is stored into a memory for later use. In step 78, the present fundamental frequency is compared to the previous fundamental frequency which has been stored in the memory. Then, the quantized fundamental frequencies are sequentially coded into note events in real time by comparing in step 78 the present fundamental frequency to the previous fundamental frequency stored in the memory if such a previous fundamental frequency exists, and applying in step 79, on the basis of the comparison, a note-on event with a pitch corresponding to the present fundamental frequency if any transition from a zero to a non-zero value on the fundamental frequency occurs. A note-off event is applied if any transition from a non-zero to a zero value on the fundamental frequency occurs, and a note-off event and a note-on event after the note-off event with a pitch corresponding to the quantized present fundamental frequency if any transition from a non-zero to another non-zero value on the fundamental frequency occurs. If the fundamental frequency does not change, no note event is applied.

Figure 8:
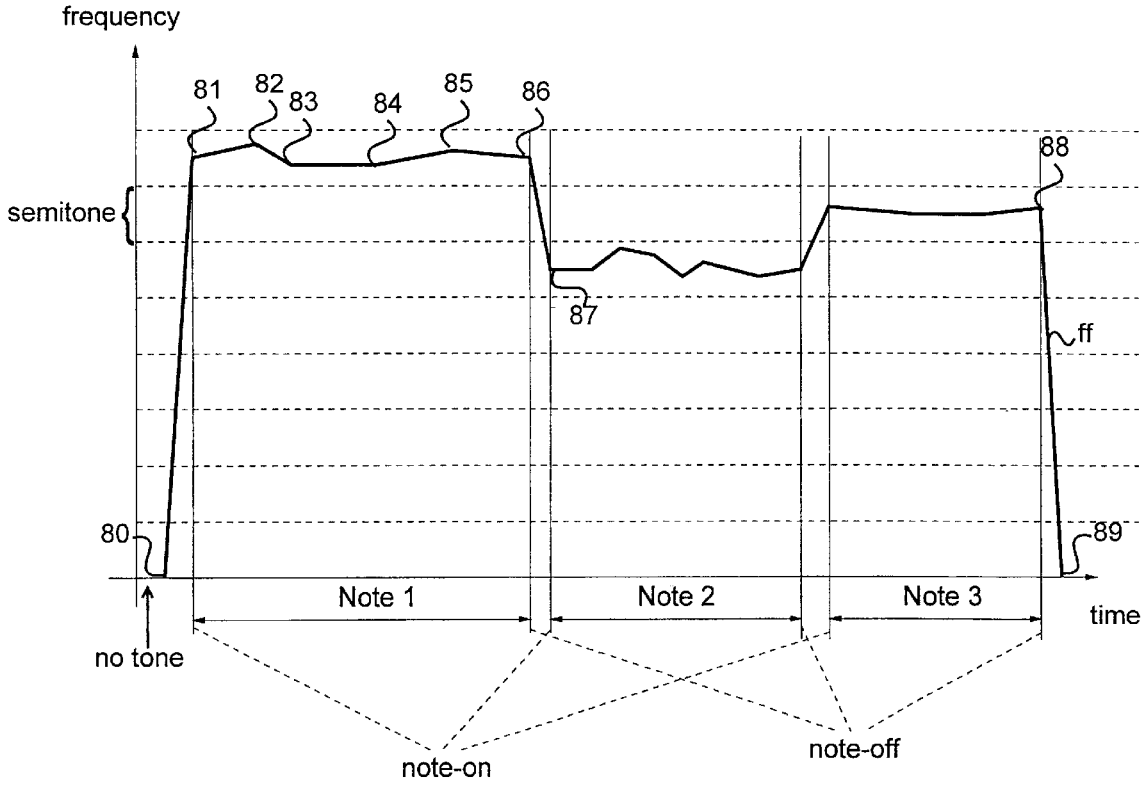
FIG. 8 is a graph illustrating an example of a fundamental frequency trajectory.

FIG. 8 illustrates an example of fundamental frequency trajectory ff. The values of the fundamental frequency that vary within the range of a semitone 81–86 are quantized into the same pitch value. In an embodiment of the invention, the consecutive equal (quantized) values 81–86 are detected and assigned as a note event Note1 comprising a note-on note-off pair and the pitch corresponding to the fundamental frequency 81. The notes Note2 and Note3 are constructed in the same way.

In another embodiment of the invention the quantized fundamental frequencies 80–89 are processed one at a time. The transition from a pause (no tone) to the Note1, i.e. from the zero fundamental frequency value 80 to the fundamental frequency value 81, results in the pitch corresponding to the fundamental frequency 81 and a note-on event. The consecutive equal fundamental frequency values 82–86 result in the corresponding pitch. The transition from the Note1 to the Note2, i.e. from the fundamental frequency value 86 to another fundamental frequency value 87, results in the pitch corresponding to the fundamental frequency 87 and a consecutive note-off and note-on event. The transition from the Note3 to a pause (no tone), i.e. from the fundamental frequency value 88 to the zero fundamental frequency value 89, results in a note-off event.

Figure 9:
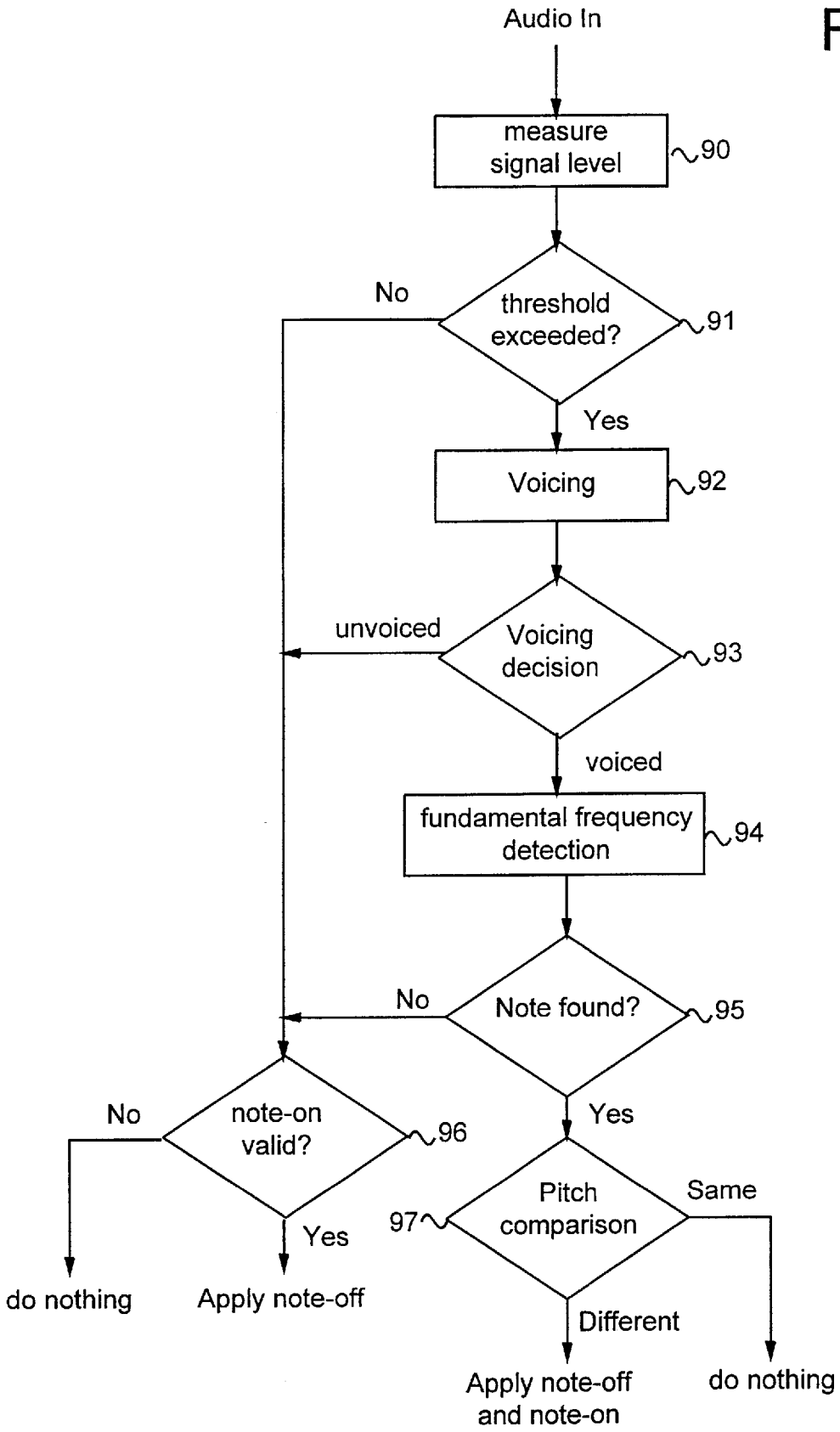
FIG. 9 is a flow diagram illustrating an audio-to-notes conversion according to still another embodiment of the invention.

FIG. 9 is a flow diagram illustrating an audio-to-notes conversion according to still another embodiment of the invention. One frame of the audio signal is investigated at a time. In step 90, the signal-level of a frame of the audio signal is measured. Typically, an energy-based signal-level measurement is applied although it is possible to use more sophisticated methods, e.g. auditorily motivated loudness measurements. In step 91, the signal level obtained from step 90 is compared to a predetermined threshold. If the signal level is below the threshold, it is decided that no tone is present in the current frame. Therefore, the analysis is aborted and step 96 will follow.

If the signal level is above the threshold, a voicing (voiced/unvoiced) decision is made in steps 92 and 93. The voicing decision is made on the basis of the ratio of the signal level at a prominent lag in the autocorrelation function of the frame to the frame energy. This ratio is determined in step 92 and in step 93, the ratio being compared with a predetermined threshold. In other words, it is determined whether there is voice or a pause in the original signal during that frame. If the frame is judged unvoiced in step 93, i.e. it is decided that no prominent harmonic tones are present in the current frame, the analysis is aborted and step 96 is executed. Otherwise, the execution proceeds to step 94.

In step 94, the fundamental frequency of the frame is estimated. Typically, the voicing decision is integrated in the fundamental frequency estimation but logically they are independent blocks, therefore presented as separate steps. In step 94, the fundamental frequency of the frame is also quantized preferably into a semitone scale, such as a MIDI pitch scale. In step 95 median filtering is applied for removing spurious peaks and for deciding whether a note was found or not. In other words, for example three consecutive fundamental frequencies are detected and if one of them greatly differs from the others, that particular frequency is rejected, because it is probably a noise peak. If no note is found in step 95, the execution proceeds to step 96. In step 96, it is detected whether a note-on event is currently valid, and if so, a note-off event is applied. If a note-on event is invalid, no action will be taken.

If a note is found in step 95, the fundamental frequency estimated in step 94 is compared to the fundamental frequency of the presently active note (of the previous frame). If the values are different, a note-off event is applied to stop the presently active note, and a note-on event is applied to start a new note event. If the fundamental frequency estimated in step 94 is the same as the fundamental frequency of the presently active note, no action will be taken.

The figures and the related description are only intended to illustrate the present invention. The principle of the invention, i.e. generating a note-based code on the basis of musical information provided in the form of an audio signal, may be executed in different ways. In its details, the invention may vary within the scope of the attached claims.

REFERENCES

[1] MIDI 1.0 specification, Document No. MIDI-1.0, August 1983, International MIDI Association

[2] Kohonen T., U.S. Pat. No. 5,418,323 *"Method for controlling an electronic musical device by utilizing search arguments and rules to generate digital code sequences"*, 1993.

[3] Hess, W., *"Pitch Determination of Speech Signals"*, Springer-Verlag, Berlin, Germany, p. 3–48, 1983.

[4] Therrien, C. W., *"Discrete Random Signals and Statistical Signal Processing"*, Prentice Hall, Englewood Cliffs, N.J., pp. 422–430, 1992.

[5] Rabiner, L. R., *"On the use of autocorrelation analysis for pitch detection"*, IEEE Transactions on Acoustics, Speech and Signal Processing, 25(1): pp. 24–33, 1977.

What is claimed is:

1. A method for generating accompaniment to a musical presentation, the method comprising steps of providing a note-based code representing musical information corresponding to the musical presentation;

generating a code sequence corresponding to new melody lines by using said note-based code as an input for a composing method; and providing accompaniment on the basis of the code sequence corresponding to new melody lines;

said step of providing the note-based code representing the musical information comprising further steps of a) receiving the musical information in the form of an audio signal; and b) applying an audio-to-notes conversion to the audio signal for generating the note-based code representing the musical information, the audio-to-notes conversion comprising the steps of estimating fundamental frequencies of the audio signal for obtaining a sequence of fundamental frequencies; and detecting note events on the basis of the sequence of fundamental frequencies for obtaining the note-based code.

2. A method according to claim 1, comprising a step of providing audible accompaniment on the basis of the code sequence corresponding to new melody lines by means of synthesized sound.

3. A method according to claim 1, comprising a step of providing accompaniment in a file format by storing the code sequence corresponding to new melody lines in the form of a sound file or a MIDI file.

4. A method for generating a note-based code representing musical information, comprising steps of a) receiving the musical information in the form of an audio signal; and b) applying an audio-to-notes conversion to the audio signal for generating the note-based code representing the musical information, the audio-to-notes conversion comprising the steps of estimating fundamental frequencies of the audio signal for obtaining a sequence of fundamental frequencies; and detecting note events on the basis of the sequence of fundamental frequencies for obtaining the note-based code, wherein step b) further comprises the steps of i) segmenting the audio signal into frames in time for obtaining a sequence of frames;

ii) estimating the fundamental frequency of a frame for obtaining a present fundamental frequency;

iii) quantizing the present fundamental frequency preferably into a semitone scale, such as a MIDI pitch scale, for producing a quantized present fundamental frequency;

iv) storing the quantized present fundamental frequency;

v) comparing the quantized present fundamental frequency to the stored fundamental frequency of the previous frame if it is available and otherwise comparing the quantized present fundamental frequency to zero;

vi) applying on the basis of the comparison in step v)

a note-on event with a pitch corresponding to the quantized present fundamental frequency if any transition from a zero to a non-zero value in the fundamental frequency occurs, a note-off event if any transition from a non-zero to a zero value in the fundamental frequency occurs, a note-off event and a note-on event after the note-off event with a pitch corresponding to the quantized present fundamental frequency if any transition from a non-zero to another non-zero value in the fundamental frequency occurs, and no note event if no change in the fundamental frequency occurs; and vii) repeating steps i) to vi) frame by frame at the same time as the audio signal is received for obtaining the note-based code.

5. A method for generating a note-based code representing musical information, comprising steps of a) receiving the musical information in the form of an audio signal; and b) applying an audio-to-notes conversion to the audio signal for generating the note-based code representing the musical information, the audio-to-notes conversion comprising the steps of estimating fundamental frequencies of the audio signal for obtaining a sequence of fundamental frequencies; and detecting note events on the basis of the sequence of fundamental frequencies for obtaining the note-based code, wherein step b) further comprises the steps of i) segmenting the audio signal into frames in time for obtaining a sequence of frames;

ii) detecting the fundamental frequency of each frame for producing a sequence of the fundamental frequencies;

iii) quantizing each value of the sequence of the fundamental frequencies preferably into a semitone scale, such as MIDI pitch scale, for producing a sequence of quantized fundamental frequencies;

iv) detecting segments of consecutive equal values in the sequence of quantized fundamental frequencies; and v) assigning each of these segments of consecutive equal values to correspond to a note event comprising a note-on note-off event pair with a corresponding pitch for obtaining the note-based code.

6. A method for generating a note-based code representing musical information, comprising steps of a) receiving the musical information in the form of an audio signal; and b) applying an audio-to-notes conversion to the audio signal for generating the note-based code representing the musical information, the audio-to-notes conversion comprising the steps of estimating fundamental frequencies of the audio signal for obtaining a sequence of fundamental frequencies; and detecting note events on the basis of the sequence of fundamental frequencies for obtaining the note-based code, wherein step b) further comprises the steps of i) segmenting the audio signal into frames in time for obtaining a sequence of frames;

ii) measuring the signal level of a frame;

iii) comparing said signal level to a predetermined signal level threshold;

iv) if said signal level threshold is exceeded in step iii), executing a voicing decision for judging whether the frame is voiced or unvoiced;

v) if the frame is judged voiced in step iv), estimating and quantizing the fundamental frequency of the frame for obtaining a quantized present fundamental frequency;

vi) deciding on the basis of the quantized present fundamental frequency whether a note is found;

vii) if a note if found in step vi), comparing the quantized present fundamental frequency to the fundamental frequency of the previous frame and applying a note-off event and a note-on event after the note-off event if said fundamental frequencies are different;

viii) if said signal level threshold is not exceeded in step iii), or if the frame is judged unvoiced in step iv), or if no note is found in step vi), detecting whether a note-on event is currently valid and applying a note-off event if a note-on event is currently valid; and repeating steps i) to viii) frame by frame at the same time as the audio signal is received for obtaining the note-based code.

7. A method according to claim 6, comprising the step of producing the audio signal by singing, humming, whistling or playing an instrument.

8. A generator for generating accompaniment to a musical presentation, said generator comprising a first routine providing a note-based code representing musical information corresponding to the musical presentation;

a second routine generating a code sequence corresponding to new melody lines by using said note-based code as an input for a composing method; and a third routine providing accompaniment on the basis of the code sequence corresponding to new melody lines;

said first routine providing the note-based code representing the musical information further comprising a) a fourth routine receiving the musical information in the form of an audio signal; and b) a fifth routine applying an audio-to-notes conversion to the audio signal for generating the note-based code representing the musical information, the audio-to-notes conversion comprising the steps of a sixth routine estimating fundamental frequencies of the audio signal for obtaining a sequence of fundamental frequencies; and a seventh routine detecting note events on the basis of the sequence of fundamental frequencies for obtaining the note-based code.

* * * * *